US005722214A

United States Patent [19]

Spatafora

[11] Patent Number: 5,722,214

[45] Date of Patent: Mar. 3, 1998

[54] DEVICE AND METHOD FOR VERIFYING THE INTEGRITY OF PRODUCT PACKAGING IN A WRAPPING MACHINE

[75] Inventor: Mario Spatafora, Bologna, Italy

[73] Assignee: Azionaria Costruzioni Macchine Automatiche A.C.M.A. S.P.A., Bologna, Italy

[21] Appl. No.: 709,657

[22] Filed: Sep. 9, 1996

[30] Foreign Application Priority Data

Sep. 8, 1995 [IL] Israel ..... BO95 A 000420

[51] Int. Cl.[6] ..... B65B 9/06; B65B 57/02

[52] U.S. Cl. ..... 53/53; 53/76; 53/505; 53/550

[58] Field of Search ..... 53/53, 52, 54, 53/451, 505, 76, 75, 67, 64, 550

[56] References Cited

U.S. PATENT DOCUMENTS 2,991,879 7/1961 Innocenti ..... 53/53 X
4,011,155 3/1977 Feurstein et al. ..... 53/53 X
4,984,409 1/1991 Focke ..... 53/53
5,412,926 5/1995 Focke ..... 53/53 X

FOREIGN PATENT DOCUMENTS 2129743 10/1972 France .
2 204 551 11/1988 United Kingdom .

*Primary Examiner*—James F. Coan
*Attorney, Agent, or Firm*—IP Group Of Pillsbury Madison & Sutro LLP

[57] ABSTRACT

In a wrapping machine that packages products by enveloping each one in a tubular wrapper with two edges united lengthwise and heat-sealed thus together, the integrity of the packaging is verified by a device comprising a feeler located at a given point along the wrapping line and offered in sliding contact to the advancing wrapper at an area coinciding with the junction between the edges and the tubular envelope. The feeler is loaded against a spring delivering a force of known intensity, and able consequently to hold a stable operating position as long as resistance is offered by the wrappers, but will find the gaps in any wrapper of which the edges have failed to unite successfully. The resulting movement of the feeler is sensed by a transducer.

8 Claims, 2 Drawing Sheets

DEVICE AND METHOD FOR VERIFYING THE INTEGRITY OF PRODUCT PACKAGING IN A WRAPPING MACHINE

BACKGROUND OF THE INVENTION

The present invention relates to a device by means of which to verify the integrity of packaging fashioned around each of a succession of products which are being packaged by a wrapping machine.

In particular, the invention relates to a device such as can be utilized with wrapping machines of the type in which packaging is applied to products by feeding the products along a wrapping line and enveloping each one in a tubular wrapper which has two longitudinal edges, projecting from the tubular portion of the wrapper and extending parallel to the direction of movement, which edges, if all goes well, are each united substantially across their full width and secured one to another. Conventionally, such wrappers are fashioned utilizing a continuous film of flexible material decoiled from a roll. Depending on the type of material utilized, the edges of the wrappers can be either heat-sealed one to another or bonded cold by means of a suitable adhesive substance applied initially to at least one of the two edges. In either instance, the edges are caused to pass between two rollers, disposed in mutual opposition and rotating convergently with the direction followed by the strip, by which the edges are compressed together. A wrapping method of the type in question is affected by certain drawbacks attributable principally to the fact that the wrapper can become displaced during the formation process from its correct position relative to the enveloped product, in which case the two edges will no longer be correctly united. It is possible as a result that when the two edges are taken up between the rollers, one will be broader than the other. In practical terms, the narrower edge does not project far enough from the tubular portion of the wrapper to allow a useful breadth of contact with the other edge and thus ensure that both edges will be engaged by the rollers. Consequently, a correct heat-seal or bond is not obtained, and at worst, the finished wrapper will have areas along which the two edges are separated by a longitudinal gap.

SUMMARY OF THE INVENTION

The object of the present invention is to provide a device applicable to a machine for wrapping products, by which the integrity of packaging can be verified automatically.

The stated object is realized in a device according to the present invention for verifying the integrity of packaging fashioned around products in a wrapping machine, typically packaging obtainable from a strip of flexible material advanced in a predetermined feed direction and folded progressively about each one of a succession of products in movement along a wrapping line in such a manner as to form a wrapper of tubular appearance which when closed has a flap disposed parallel to the feed direction and projecting radially from the wrapper, wherein the flap is made of the united longitudinal edges of the strip and is engaged by feeler means operating in a direction substantially transverse to the feed direction.

The invention relates also to a method by which to verify the integrity of product packaging in a wrapping machine, at a given point along a wrapping line. A method according to the invention for verifying the integrity of product packaging in a wrapping machine comprises the steps of advancing a strip of flexible film material along a wrapping line, folding the film about each one of a succession of products in movement along the wrapping line, so as to fashion a wrapper of tubular appearance with two united longitudinal edges projecting from the tubular portion of the wrapper and (if all has gone well) sealed or bonded together, and thereafter, subjecting the advancing wrapper at a point near the edges to a force of intensity such as will encounter opposition in the resistance offered by the wrapper when the two edges are united substantially across their full width and correctly sealed or bonded. By the same token, no opposition will be encountered in the event that the edges are not completely united and thus are not correctly sealed or bonded.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
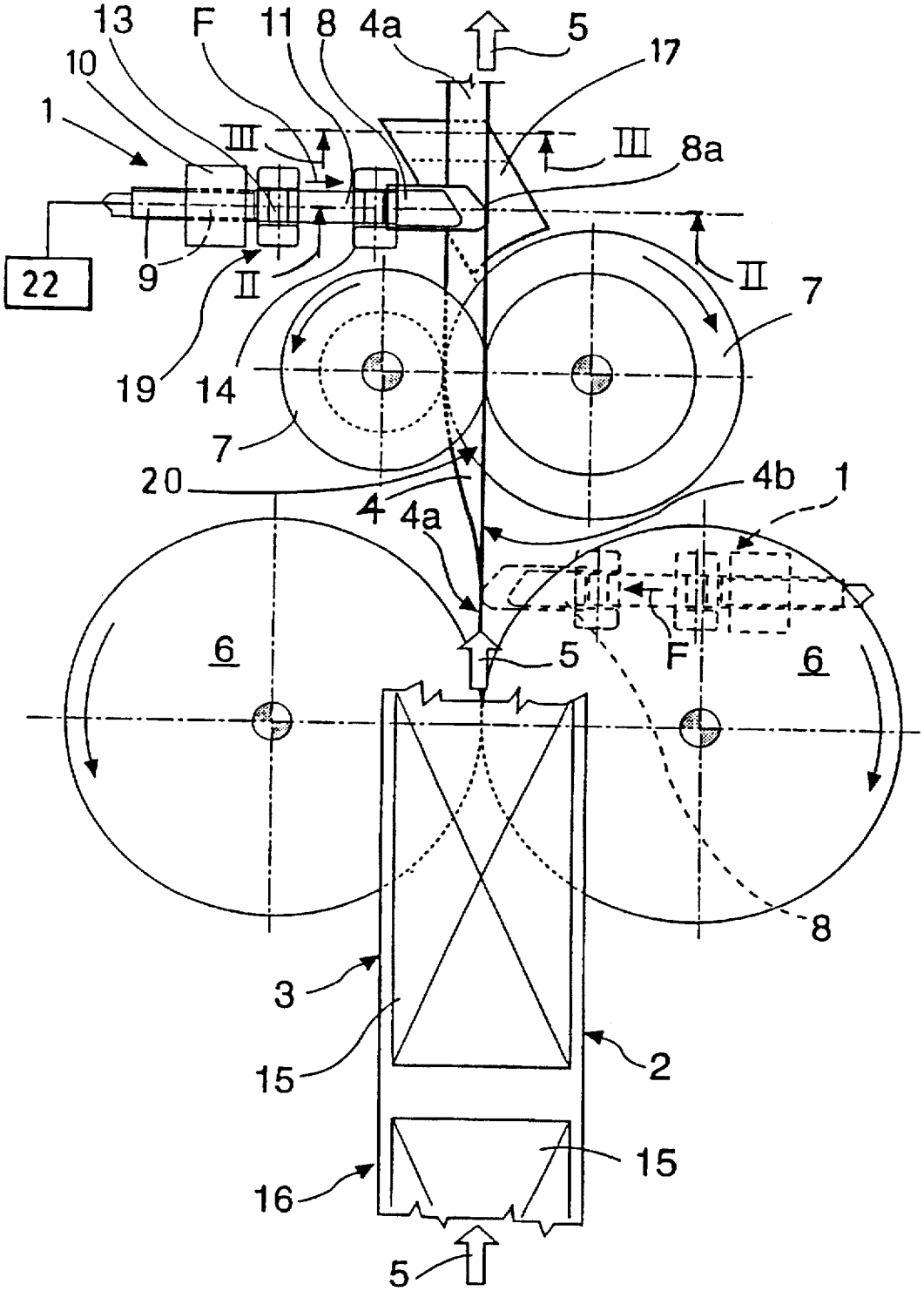
FIG. 1 is a schematic illustration of the device according to the invention associated with a product wrapping line and viewed in plan.
Figure 2:
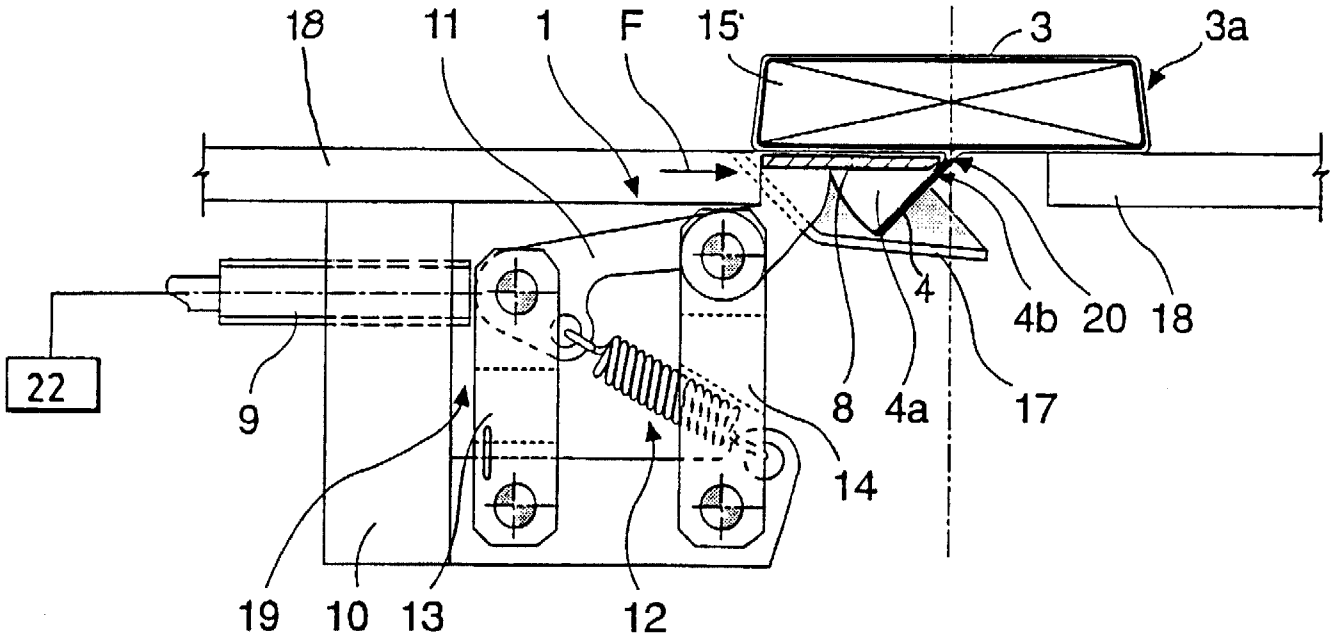
FIGS. 2 and 3 are two sectional illustrations of the device taken respectively on lines II—II and III—III of FIG. 1.

Referring to FIGS. 1 and 2 of the drawings, the numeral 1 denotes a device, in its entirety, for verifying the integrity of packaging fashioned around products 15, such as can be utilized in a wrapping machine.

Figure 4:
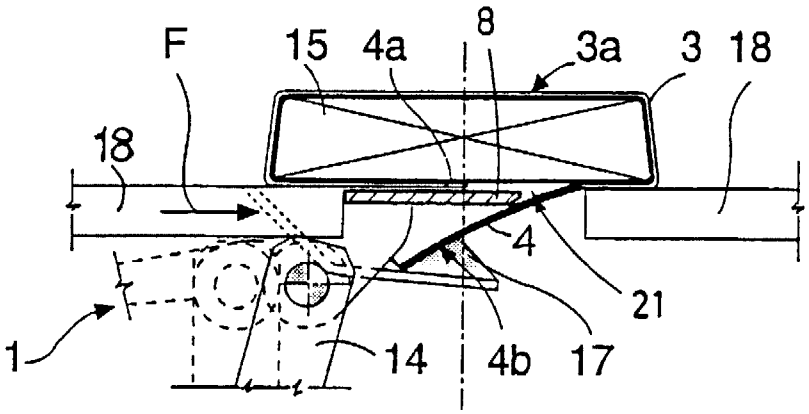
FIG. 4 is a further section taken on II—II of FIG. 1, illustrating a situation in which the tubular wrapper has a longitudinal gap between its edge margins.
Figure 3:
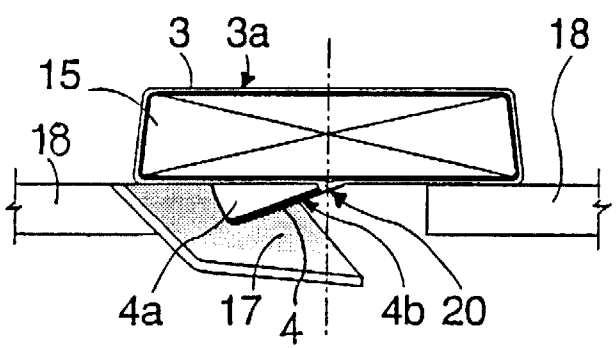

The packagings are obtained from a continuous strip 16 of flexible material, which is advanced along a feed direction denoted 5 and folded around the successive products 15 as these are in movement along a wrapping line 2 in such a way as to form a wrapper 3 of tubular appearance. In its closed tubular configuration, the wrapper 3 has a flap 4 projecting outwardly from the tubular portion and extending parallel with the feed direction 5. The flap 4 is created when the longitudinal edge margins **4*a* and 4*b* of the strip, beyond the tubular portion of the wrapper 16, are united confrontingly facewise one with another. Also indicated in FIGS. 2, 3 and 4 is a conveying table 18 along which the single products 15 are caused to advance, each enveloped in a respective wrapper 3, or in a respective segment of the wrapper 3**, unless and until the packaging strip stock is cut into individual pieces, whether before or after the strip stock is wrapped about the products.

The two edge margins **4*a* and 4*b* are caused to pass between two rollers 6** from which they emerge compressed and sealed or bonded together confronting face to confronting face.

FIG. 1 illustrates a portion of the wrapping line 2 comprising two rollers 6 (referred to elsewhere in the specification as "heat-seal rollers" for the sake of simplicity), which are rotatable about mutually parallel vertical axes.

In the example shown in the drawings, the edge margins **4*a* and 4*b* of the strip are shown as projecting from the underside of the tubular portion 3*a* presented by the wrapper 3. In order to illustrate the already united edge margins 4*a* and 4*b* in FIG. 1, accordingly, the stretch of the wrapping line 2 extending beyond the heat-seal rollers 6 in the feed direction 5 is depicted omitting both the tubular wrapper 3 and the enveloped product 15. In this way it becomes possible both to show the two edge margins 4a and 4b and to indicate the junction, denoted 20, between the edge margins and the tubular portion 3a of the wrapper 3. The wrapping line 2 also comprises two frusto-conical bending rollers 7, which are rotatable about vertical axes and with mating profiles, between which the edge margins 4a and 4b are caused to pass, once they have been subjected to the heat-sealing step. The function of these rollers 7 is to bend the two edge margins 4a and 4b initially toward the tubular portion 3a**.

With reference in particular to FIG. 2, the device 1 to which the invention relates comprises a frame 10, and, articulated to the frame, a pair of mutually parallel arms 13 and 14 interconnected by a rod 11 in such a way as to form a quadrilateral linkage 19 occupying a plane normal to the feed direction 5 of the conveying line 2.

The device 1 further comprises feeler means, carried by a free end of the rod 11, of which the actual feeler element 8 appears as a flat horizontal leaf disposed substantially parallel with and riding against the underside of a tubular portion 3a advancing along the wrapping line 2, also tension means 12, represented in FIG. 2 as a spring 12 of which the two opposite ends are anchored respectively to the frame 10 and to the rod 11. The function of the spring is to subject the rod, and therefore the feeler 8, to a force of given intensity and direction such as will maintain a stable operating position whereby the feeler 8 stays in sliding contact with the wrappers 3 (or wrapper segments) moving along the wrapping line 2. The force in question, and the relative direction, are indicated by the arrow denoted F in FIGS. 1, 2 and 4. The feeler 8 terminates in a rounded tip 8a (FIG. 1) positioned to interact with the wrappers 3, as will be described more fully in due course. The tip 8a of the feeler 8 is designed to enter into contact with a wrapper 3 preferably at the area of the junction 20 between the edge 4a and 4b and the tubular portion 3a. The area across which the edge margins 4a and 4b are effectively heat-sealed, given a correctly made join, commences immediately beyond the junction 20 in the outward direction.

The device 1 according to the invention is shown in FIG. 1 (continuous lines) operating beyond the bending rollers 7 in the feed direction, from a position to one side of the edge margins 4a and 4b and facing the edge margin denoted 4a. In the example illustrated, the tip 8a of the feeler 8 engages in contact with the area of the junction 20 on the inside of the angle formed by the two edge margins 4a and 4b when bent toward the underside of the tubular portion 3a of the wrapper 3.

The option also exists, alternatively or additionally, of locating the device 1 at a given point between the heat-seal rollers 6 and the bending rollers 7. This solution is illustrated likewise in FIG. 1, which shows the device (shown in phantom lines) positioned on the opposite side, facing the edge margin denoted 4b. In this instance, the feeler 8 will engage the area of the junction 20 by entering into contact with the corresponding edge margin 4b, and more exactly with the angle formed between the edge margins 4b and the tubular portion 3a of the wrapper 3, at a point along the wrapping line 2 where the two edges 4a and 4b have not yet been bent and are thus disposed substantially perpendicular to the tubular portion 3a.

In each case, the resultant generated by the spring 12 and the parallelogram through the feeler 8 is applied in a direction F substantially transverse to the feed direction 5 followed by the wrappers 3.

The numeral 9 denotes a proximity transducer associated with one member of the quadrilateral linkage 19, for example the rod 11, and capable of detecting any movement of the feeler 8 away from its stable operating position. Immediately beyond the device 1, following the feed direction 5, is a fixed folding element 17 typically providing an inclined plane angled in such a way as to induce a further bending action by which the edge margins 4a and 4b of the wrapper 3 are substantially flattened against the underside of the tubular portion 3a. In operation, as long as the wrappers 3 continue to advance with their two longitudinal edge margins 4a and 4b correctly united and heat-sealed, the feeler 8 remains in a condition substantially of static equilibrium, which for the purposes of verifying the integrity of the wrapper 3 will correspond to the stable operating position aforementioned, i.e. a position maintained when the action of the spring 12 is opposed by the reaction of the wrapper 3 registering at the area of the junction 20.

In this situation, illustrated in FIGS. 1 and 2, the feeler 8 remains substantially motionless by virtue of the fact that when correctly united and heat-sealed, the advancing edge margins 4a and 4b continue to hold their positions relative to one another when passing through the device 1, signifying that there are no breaks in continuity along the area of the junction 20 such as would diminish the reaction offered by the wrapper 3 to the action of the spring 12 applied through the feeler 8. Conversely, FIG. 4 shows a situation in which the two longitudinal edge margins 4a and 4b of the advancing wrapper 3 are unequally proportioned. In the example illustrated, the edge denoted 4b is broader than that denoted 4a. Thus, with one edge margin 4a failing to project from the tubular portion 3a of the wrapper 3, there is no available width that can be utilized to fashion a lapped joint with the remaining edge margin 4b.

The feeler 8 is illustrated in FIG. 4 displaced from its position of static equilibrium by the force of the spring 12, as a result of the edge margins 4a and 4b having failed to unite and consequently been unable to offer any resistance, or at least able to offer insufficient resistance, to the action of the spring 12. The upshot in any event is that the feeler 8 will find the gap left between the two longitudinal edge margins 4a and 4b and slip between the product 15 and the tubular portion 3a of the wrapper 3. In other words, the spring 12 is capable of generating a force P, applied through the feeler 8, such as will be opposed by the resistance the wrapper 3 is able to offer when the edge margins 4a and 4b are correctly united and heat-sealed. Equally, in the event that any of the wrappers 3 should present longitudinal gaps 21, the same force P will also be sufficient to push the feeler 8 into the gaps 21. The proximity transducer 9 is set up in such a way as to generate a signal when the rod 11 and the feeler 8 are displaced from the aforementioned condition of equilibrium.

The device 1 further comprises means of conventional embodiment, illustrated simply as a block denoted 22 in the drawings, capable of receiving the signal from the proximity transducer 9, identifying any wrapper 3 with incorrectly united longitudinal edges 4a and 4b and thereupon triggering its rejection. Such means 22 might also be capable of piloting the wrapping machine to shut off automatically, so that the operator can remove substandard packagings and remedy the cause of the trouble.

What is claimed is:

1. A method for verifying the integrity of a longitudinal seam on each of a succession of packaged products, comprising:

while conveying a succession of individual products in a longitudinal direction along a path, wrapping convolutely in a wrapping direction about each product at a wrapping station, a strip of flexible material which is greater in corresponding dimension that the girth of the product in the wrapping direction so as to create a wrapped product having a tubular wrapper and two edge marginal portions and dispose said edge marginal portions in facially confronting relation;

attempting to seal between said edge marginal portions for each wrapped product to create a respective tab;

supporting and positioning a feeler beside said path to engage each packaged product at a predetermined location which, if the sealed flap has been successfully provided for a respective wrapped product causes the feeler to assume only a given position while engaging the respective packaged product, and if the sealed product has not been successfully provided for the respective product causes the feeler to assume a position other than said given position while engaging the respective wrapper product; and sensing via a sensor operatively associated with the feeler whether the feeler is positioned in other than said given position while engaging a respective packaged product, and in such case providing an indication that the respective packaged product has been defectively sealed at the respective flap.

2. A device for verifying the integrity of a longitudinal seam provided by transversely convolutely wrapping a strip having two longitudinal edge margins about a succession of products, so as to form a tubular wrapper about each product, and place the two longitudinal edge margins in facially confronting relation, and attempting to seal the two longitudinal edge margins to one another so as to create a flap which projects away from the tubular wrapper, as the products and strip are advanced in a longitudinal direction along a path to become a succession of packaged products, said device comprising:

a feeler supported and positioned by a support to engage each packaged product at a predetermined location which, if the sealed flap has been successfully provided for a respective wrapped product causes the feeler to assume only a given position while engaging the respective packaged product, and if the sealed product has not been successfully provided for the respective product causes the feeler to assume a position other than said given position while engaging the respective wrapper product; and a sensor for sensing whether the feeler is positioned in other than said given position while engaging a respective packaged product, and in such case providing an indication that the respective packaged product has been defectively sealed at the respective flap.

3. The device of claim 2, wherein:

said predetermined location is at a junction of one of said edge margins with said tubular wrapper.

4. The device of claim 2, further including:

spring-loading means associated with said feeler for tending to cause said feeler to assume a position other than said given position while engaging a respective wrapped product.

5. The device of claim 2, further comprising:

control means associated with said sensor, for identifying and indicating that a respective packaged product has been defectively sealed at the respective flap.

6. The device of claim 4, further including a frame; and said feeler being supported and positioned relative to said frame by being mounted to a bar which is pivotally mounted to two arms to provide with said frame a quadrilateral linkage; and said spring-loading means is arranged to act between said frame and said rod.

7. The device of claim 6, wherein:

said sensor comprises a proximity transducer arranged to sense proximity to a site on said quadrilateral linkage which moves relative to said frame as said feeler moves from said given position while engaging a respective packaged product.

8. The device of claim 2, wherein:

said feeler comprises a flat leaf element having a rounded tip positioned to engage each packaged product at the respective said predetermined location.

* * * * *